US010900704B2

(12) United States Patent
Jia et al.

(10) Patent No.: US 10,900,704 B2
(45) Date of Patent: Jan. 26, 2021

(54) REFRIGERATOR HAVING AN ICE-MAKING SYSTEM WITH AN ICE-MAKING CHAMBER DISPOSED INSIDE A REFRIGERATING COMPARTMENT

(71) Applicants: HEFEI HUALING CO., LTD., Hefei (CN); HEFEI MIDEA REFRIGERATOR CO., LTD., Hefei (CN); MIDEA GROUP CO., LTD., Foshan (CN)

(72) Inventors: Ying Jia, Hefei (CN); Zengqiang Si, Hefei (CN); Dongxian Liu, Hefei (CN); Xuezai Zheng, Hefei (CN); Fei Lu, Hefei (CN); Yu Li, Hefei (CN); Deming Wei, Hefei (CN)

( * ) Notice: Subject to any disclaimer, the term of this patent is extended or adjusted under 35 U.S.C. 154(b) by 0 days.

(21) Appl. No.: 16/724,364

(22) Filed: Dec. 22, 2019

(65) Prior Publication Data

US 2020/0166268 A1 May 28, 2020

Related U.S. Application Data

(63) Continuation of application No. PCT/CN2019/070279, filed on Jan. 3, 2019.

(30) Foreign Application Priority Data

Nov. 28, 2018 (CN) ..... 2018 1 1437240

(51) Int. Cl.
*F25C 1/00* (2006.01)
*F25D 17/06* (2006.01)
(Continued)

(52) U.S. Cl.
CPC ..... *F25D 17/067* (2013.01); *F25C 1/00* (2013.01); *F25D 11/02* (2013.01); *F25D 17/065* (2013.01); *F25D 17/08* (2013.01)

(58) Field of Classification Search
CPC ..... F25D 17/06; F25D 17/062; F25D 17/065; F25D 17/067; F25D 17/08; F25D 11/02; F25C 1/00
See application file for complete search history.

(56) References Cited

U.S. PATENT DOCUMENTS 8,336,330 B2 * 12/2012 Lee ..... F25C 5/005 62/344
2008/0134708 A1 6/2008 Lee et al.
(Continued)

FOREIGN PATENT DOCUMENTS

CN 1412509 A 4/2003
CN 106885420 A 6/2017
(Continued)

OTHER PUBLICATIONS

The first Office Action dated Jul. 24, 2019 in the corresponding CN application No. 201811437240.2.
(Continued)

*Primary Examiner* — Edward F Landrum
*Assistant Examiner* — Daniel C Comings
(74) *Attorney, Agent, or Firm* — Kilpatrick Townsend & Stockton, LLP

(57) ABSTRACT

The present disclosure discloses a refrigerator having a separate ice-making system, comprising: a refrigerating compartment and an ice-making chamber disposed inside the refrigerating compartment, wherein an ice maker is arranged inside the ice-making chamber, the ice-making chamber is supplied with cold air by an ice-making refrigeration system including an ice-making evaporator, an ice-making air supply duct, an ice-making fan and an ice-making air return duct, the ice-making air supply duct and the ice-making air return duct are arranged in parallel, the ice-making evaporator is disposed inside the refrigerating compartment and outside the ice-making chamber, and the
(Continued)

ice-making evaporator is communicated with the ice maker through the ice-making air supply duct and the ice-making air return duct to form a refrigerating circulation loop.

8 Claims, 6 Drawing Sheets

(51) Int. Cl.
*F25D 17/08* (2006.01)
*F25D 11/02* (2006.01)

(56) References Cited

U.S. PATENT DOCUMENTS

2008/0148745 A1* 6/2008 Zhang ..... F25D 11/022 62/113
2011/0100046 A1* 5/2011 Choi ..... F25C 5/22 62/320
2018/0164017 A1 6/2018 Jeong et al.

FOREIGN PATENT DOCUMENTS

CN 106907889 A 6/2017
CN 107255383 A 10/2017
JP H0289979 A 3/1990
KR 20030030961 A 4/2003
KR 20080014552 A 2/2008

OTHER PUBLICATIONS

International Search Report dated Sep. 2, 2019 in the corresponding International Application No. PCT/CN2019/070279.
Written Opinion of the ISA corresponding to International Application No. PCT/CN2019/070279.
Extended European Search Report of EP Application No. 19848923.9.

* cited by examiner

REFRIGERATOR HAVING AN ICE-MAKING SYSTEM WITH AN ICE-MAKING CHAMBER DISPOSED INSIDE A REFRIGERATING COMPARTMENT

CROSS-REFERENCE TO RELATED APPLICATION

The present disclosure is a national phase application of International Application No. PCT/CN2019/070279, filed on Jan. 3, 2019, which claims the priority of Chinese Application No. 201811437240.2, filed in the Chinese Patent Office on Nov. 28, 2018, the entireties of which are herein incorporated by reference.

FIEID

The present disclosure relates to the field of household appliances technologies, and particularly to a refrigerator having a separate ice-making system.

BACKGROUND

At present, an ice-making evaporator in the existing refrigerator is typically disposed in the ice-making chamber, and thus the effective area of the ice-making evaporator is still limited by the size of the ice-making chamber, and it cannot match the heat load demand of the ice maker well, thereby affecting the ice making speed of the ice maker. At the same time, the frost-reducing capacity of the ice-making evaporator itself is also affected which requires frequent heating and defrosting, resulting in energy consumption loss and affecting the quality of ice cubes stored in the ice bucket.

SUMMARY

An object of the present disclosure is to provide a refrigerator with a separate ice-making system capable of solving at least one of the technical problems in the prior art that the effective area of the ice-making evaporator is limited and the ice-making efficiency is affected since the ice-making evaporator in the existing refrigerator is typically disposed in the ice-making chamber.

The present disclosure provides a refrigerator having a separate ice-making system, comprising: a refrigerating compartment and an ice-making chamber disposed inside the refrigerating compartment, wherein an ice maker is arranged inside the ice-making chamber, the ice-making chamber is supplied with cold air by an ice-making refrigeration system including an ice-making evaporator, an ice-making air supply duct, an ice-making fan and an ice-making air return duct, the ice-making air supply duct and the ice-making air return duct are arranged in parallel, the ice-making evaporator is disposed inside the refrigerating compartment and located outside the ice-making chamber, and the ice-making evaporator is communicated with the ice maker through the ice-making air supply duct and the ice-making air return duct to form a refrigerating circulation loop.

In an embodiment of the present disclosure, the refrigerator further comprises a refrigerating ice-making air duct disposed in the refrigerating compartment, the refrigerating ice-making air duct includes an air duct front cover plate, air duct foam, and an air duct rear cover plate disposed in order from front to rear, wherein the ice-making air return duct is constructed between the air duct foam and the air duct rear cover plate, and the air duct front cover plate is disposed on an outer side surface of the rear side wall of a refrigerating compartment liner.

In an embodiment of the present disclosure, the ice-making air supply duct is constructed between the air duct rear cover plate and the rear side wall of the refrigerating compartment liner, and the ice-making evaporator is installed in the ice-making air supply duct.

In an embodiment of the present disclosure, the refrigerator further comprises a defrosting heating tube disposed below the ice-making evaporator and proximal to the outsides of the ice-making air supply duct and the ice-making air return duct.

In an embodiment of the present disclosure, the ice-making air supply duct and the ice-making air return duct are both located between the ice-making evaporator and the ice maker; the ice-making fan is disposed between the ice-making air supply duct and the ice-making air return duct through an ice-making fan base; an ice-making inner air duct is constructed in the ice maker, and the ice-making air supply duct, the ice-making inner air duct and the ice-making air return duct are sequentially connected to form the refrigerating circulation loop.

In an embodiment of the present disclosure, the refrigerator further comprises a cover plate assembly disposed on a rear side of the ice maker and capable of sealing the inside of the ice maker, the cover plate assembly includes an ice maker front cover plate, ice maker back cover foam, and an ice maker rear cover plate disposed in order from front to rear; and the ice-making evaporator is mounted on an outer side of the rear side wall of the refrigerating compartment liner.

In an embodiment of the present disclosure, the refrigerator further includes a refrigerating refrigeration system disposed in the refrigerating compartment, the refrigerating refrigeration system includes a refrigerating evaporator, a refrigerating air supply duct, a refrigerating fan, and a refrigerating air return duct, wherein the refrigerating air supply duct is constructed between the air duct foam and the air duct rear cover plate, the refrigerating fan directs cold air into the refrigerating air supply duct; and the refrigerating air return duct is constructed between the air duct rear cover plate and the rear side wall of the refrigerating compartment liner.

In an embodiment of the present disclosure, the air duct front cover plate and the air duct rear cover plate are mounted on an outer side of the rear side wall of the refrigerating compartment liner by screws.

In an embodiment of the present disclosure, in the ice-making air supply duct, the air duct foam and the ice maker rear cover foam are engaged and sealed in a concave-convex manner by a first fitting surface; the air duct rear cover plate and the ice maker rear cover plate are lapped and sealed from front to rear and sealed by a second fitting surface; the air duct foam and the refrigerating compartment liner are sealed by a third fitting surface at the lower part; and the air duct rear cover plate and the refrigerating compartment liner are fixedly sealed by a four fitting surface through a screw at the left side.

In an embodiment of the present disclosure, in the ice-making air return duct, the air duct foam and the ice maker rear cover foam are engaged and sealed in a concave-convex manner by a fifth fitting surface; the air duct foam and the ice maker rear cover plate are lapped and sealed by a sixth fitting surface; the air duct rear cover plate and the ice maker rear cover plate are lapped and sealed from front to rear by a seventh fitting surface; and the air duct rear cover plate and the refrigerating compartment liner are sealed by an eighth fitting surface through a sponge at the right side.

Description of the reference numbers

Figure 1:
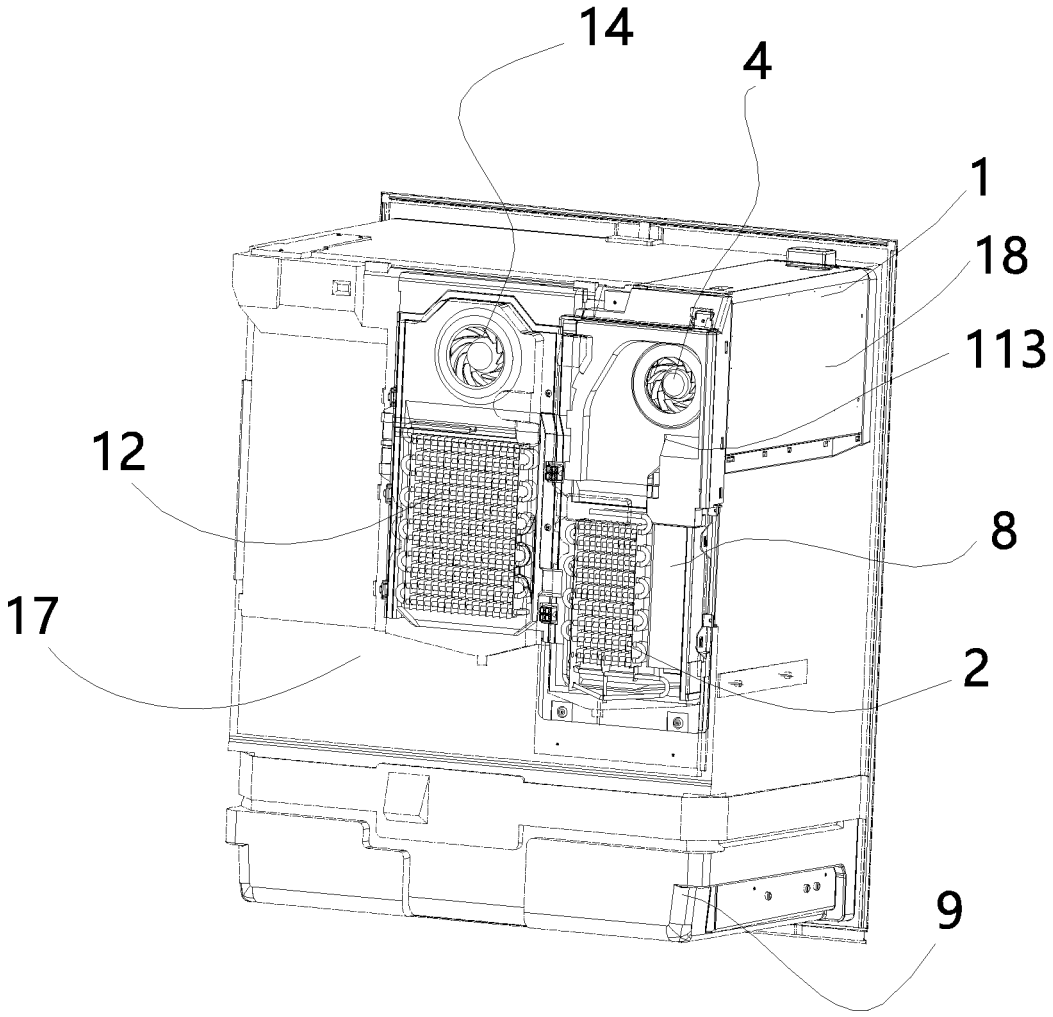
FIG. 1 is a schematic view showing the overall structure of a refrigerator having a separate ice-making system according to some embodiments of the present disclosure.

| | | | |
|---|---|---|---|
| 1 | ice maker | 1a | ice-making inner air duct |
| 2 | ice-making evaporator | 3 | ice-making air supply duct |
| 4 | ice-making fan | 5 | ice-making air return duct |
| 6 | air duct front cover plate | 7 | air duct foam |
| 8 | air duct rear cover plate | 9 | refrigerating compartment liner |
| 10 | defrosting heating tube | | |
| 111 | ice maker front cover plate | 11 | cover plate assembly |
| | | 112 | ice maker rear cover foam |
| 113 | ice maker rear cover plate | 12 | refrigerating evaporator |
| 13 | refrigerating air supply duct | 14 | refrigerating fan |
| | | 3-9-2 | first fitting surface |
| 16 | ice-making fan base | 3-13-1 | third fitting surface |
| 5-10-2 | second fitting surface | 3-9-1 | fifth fitting surface |
| 5-13-1 | fourth fitting surface | 5-10-1 | seventh fitting surface |
| 3-10-1 | sixth fitting surface | 17 | refrigerating compartment |
| 5-13-2 | eighth fitting surface | 19 | refrigerating ice-making air duct |
| 18 | ice-making chamber | | |
| 20 | refrigerating air return duct | 21 | air cavity |

DETAILED DESCRIPTION

The specific implementations of the present disclosure are further described in detail below in conjunction with the drawings and embodiments. The following examples are intended to illustrate the disclosure, but are not intended to limit the scope of the disclosure.

In the description of the present disclosure, it is to be noted that unless explicitly stated and defined otherwise, the terms "installed," "connected with," and "connected" shall be understood broadly, for example, it may be either fixedly connected or detachably connected, or can be integrated; it may be mechanically connected, or electrically connected; it may be directly connected, or indirectly connected through an intermediate medium, or may be internal communication between two elements. The specific meanings of the terms above in the present disclosure can be understood by a person skilled in the art in accordance with specific conditions

Embodiment 1

As shown in FIGS. 1 to 6, an example refrigerator in accordance with the disclosure is shown to include a refrigerating compartment 17 and an ice-making chamber 18 disposed inside the refrigerating compartment 17. Of course, in the interior of the refrigerator, there may be compartments such as a freezing compartment and a temperature-changing compartment. The specific form of the refrigerator is not specifically limited, and may be a cross-door refrigerator having a refrigerating compartment 17 above and two compartments below, and the like.

An ice maker 1 is disposed inside the ice-making chamber 18 which is supplied with cold air by an ice-making refrigeration system including an ice-making evaporator 2, an ice-making air supply duct 3, an ice-making fan 4 and an ice-making air return duct 5. As can be seen, in this embodiment, the ice-making air supply duct 3 and the ice-making air return duct 5 are arranged in parallel. In this embodiment, the ice-making evaporator 2 is disposed inside the refrigerating compartment 17 and located outside the ice-making chamber 18, and the ice-making evaporator 2 is in communication with the ice maker 1 through the ice-making air supply duct 3 and the ice-making air return duct 5 to form a refrigerating circulation loop. As shown in this embodiment, the cold air of the ice-making evaporator 2 is introduced into the inside of the ice maker 1 through the ice-making air supply duct 3 by the ice-making fan 4 and exchanges heat with the air in the ice maker 1 after being transferred to the ice maker 1, heat-exchanged cold air is introduced back to the inside of the ice-making evaporator 2 by the ice-making air return duct 5 and the heat exchange is repeated, and the above steps are executed cyclically.

The arrangement of the ice-making fan 4 can speed up the flow velocity of cold air as well as the refrigerating circulation, thereby improving the refrigerating efficiency.

In the present disclosure, the ice-making evaporator 2 disposed in the refrigerating compartment 17 and outside the ice-making chamber 18 is connected to the ice maker 1 through both the ice-making air supply duct 3 and the ice-making air return duct 5, and a defrosting heating tube 10 described below in the ice-making evaporator 2 is disposed distal from the ice-making chamber 18 and an ice storage bucket in the ice-making chamber 18 and thus the heat transfer to the ice-making chamber 18 during the heating and defrosting of the ice-making evaporator 2, especially the heat transfer into the ice storage bucket, is reduced. As a result, ice cubes in the ice storage bucket are prevented from melting on the surfaces of the ice cubes during the heating and defrosting, thereby further effectively improving the ice-making efficiency.

In an embodiment of the present disclosure as shown in FIG. 1, the ice-making evaporator 2 may be disposed at the rear of the ice-making chamber 18.

In addition, since the space in the refrigerating compartment 17 is much larger than the space of the ice-making evaporator 2, it is convenient to install the ice-making evaporator 2 in the refrigerating compartment 17 but outside of the ice-making chamber 18. This also increases the effective area of the ice-making evaporator 2. Other benefits of such an arrangement of the ice-making evaporator include, but not limited to, the heat load of the ice maker 1 and the area of the ice-making evaporator 2 are more rationally matched, the ice-making speed of the ice maker 1 is increased, the frost-reducing capacity of the ice-making evaporator 2 is improved, the heating defrosting frequency of the ice-making evaporator 2 is lowered, the energy consumption is reduced, and the surface quality of the ice cubes is improved. Although in this embodiment, it is shown that the evaporator 2 is placed below the ice-making chamber 18, this is not intended to be limiting. It is contemplated in some other embodiments, for example the evaporator 2 may be placed behind or on top of the ice-making chamber 18.

In the present disclosure, since the ice maker 1 and the ice-making evaporator 2 are disposed in the refrigerating compartment 17 of the refrigerator respectively, the cold air is introduced, by fan 4, into the inside of the ice maker 1 in the ice-making chamber 18 through ice-making air supply duct 3—in a reduced length—for making ice, and thus the loss of cooling capacity is small and the ice-making efficiency is ensured.

In addition, since the ice-making air supply duct 3 and the ice-making air return duct 5 in the present disclosure are arranged in parallel in the refrigerating compartment 17, the ice-making air supply duct 3 and the ice-making air return duct 5 can each be made thinner, and thus the occupied space inside the refrigerating compartment 17 of the refrigerator can be decreased and the available volume of the refrigerator can be increased.

In some other embodiments, positions of the ice-making air supply duct 3 and the ice-making air return duct 5 may be interchanged. That is, the ice-making air supply duct 3 can be located on the left side of the ice-making air return duct 5 and can also be located on the right side of the ice-making air return duct 5.

Figure 2:
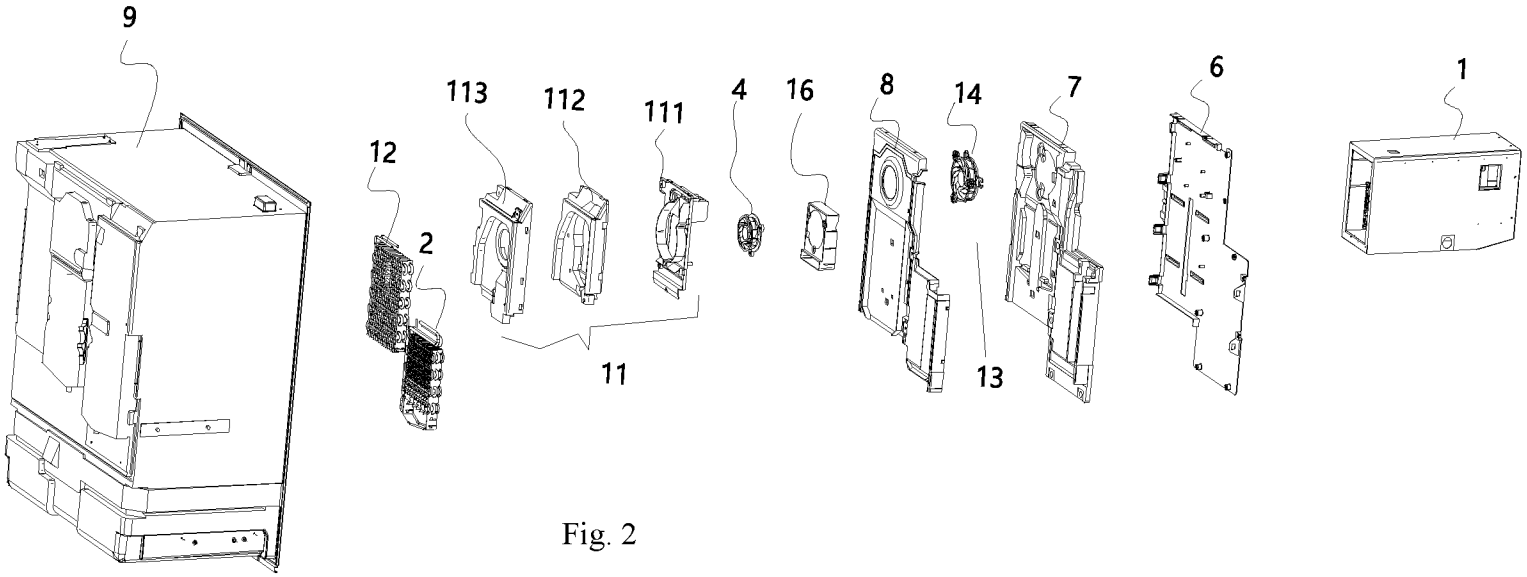
FIG. 2 is a schematic view showing a general assembly explosion structure of a refrigerator having a separate ice-making system according to some embodiments of the present disclosure.

As shown in FIGS. 1 and 2, for further optimizing the refrigerator, the refrigerator, on the basis of the above technical solution, further comprises a refrigerating ice-making air duct 19 disposed in the refrigerating compartment 17, the refrigerating ice-making air duct 19 includes an air duct front cover plate 6, air duct foam 7, and an air duct rear cover plate 8 disposed in order from front to rear, wherein an ice-making air return duct 5 is constructed between the air duct foam 7 and the air duct rear cover plate 8, and the air duct front cover plate 6 is disposed on an outer side surface of the rear side wall of a refrigerating compartment liner 9. As can be seen in this embodiment, the refrigerating ice-making air duct 19 may be shared by a refrigerating air supply duct 13, a refrigerating air return duct 20, the ice-making air supply duct 3, and the ice-making air return duct 5 as described below. This greatly improves the versatility between the structural members, saves both installation space and raw materials, and reduces the difficulty of the manufacturing process.

It should be noted that the left and right sides and the lower sides of the ice-making air supply duct 3 and the ice-making air return duct 5 of the present disclosure can be fixed by the air duct rear cover plate 8 and the refrigerating compartment liner 9. The upper sides of the ice-making air supply duct 3 and the ice-making air return duct 5 can be fixed by the ice maker rear cover plate 113 as described below so as to realize the sealing between the ice-making air supply duct 3 and the ice-making air return duct 5 in the ice-making refrigeration system and the refrigerating compartment 17, thereby preventing the cold air in the ice-making refrigeration system from entering the refrigerating compartment 17. Further, it is avoided to affect the normal temperature in the refrigerating compartment 17 and ensure the normal operation of the refrigerating compartment 17.

Figure 3:
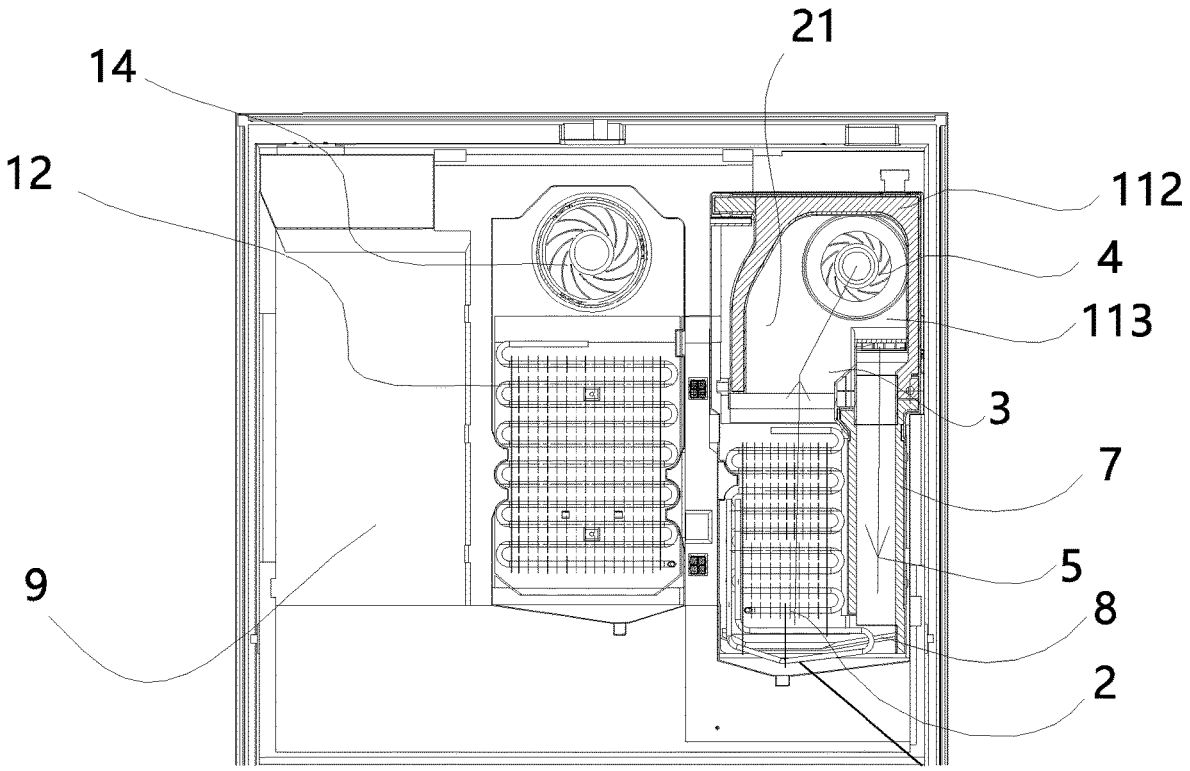
FIG. 3 is a schematic view of the back structure of FIG. 1.
Figure 5:
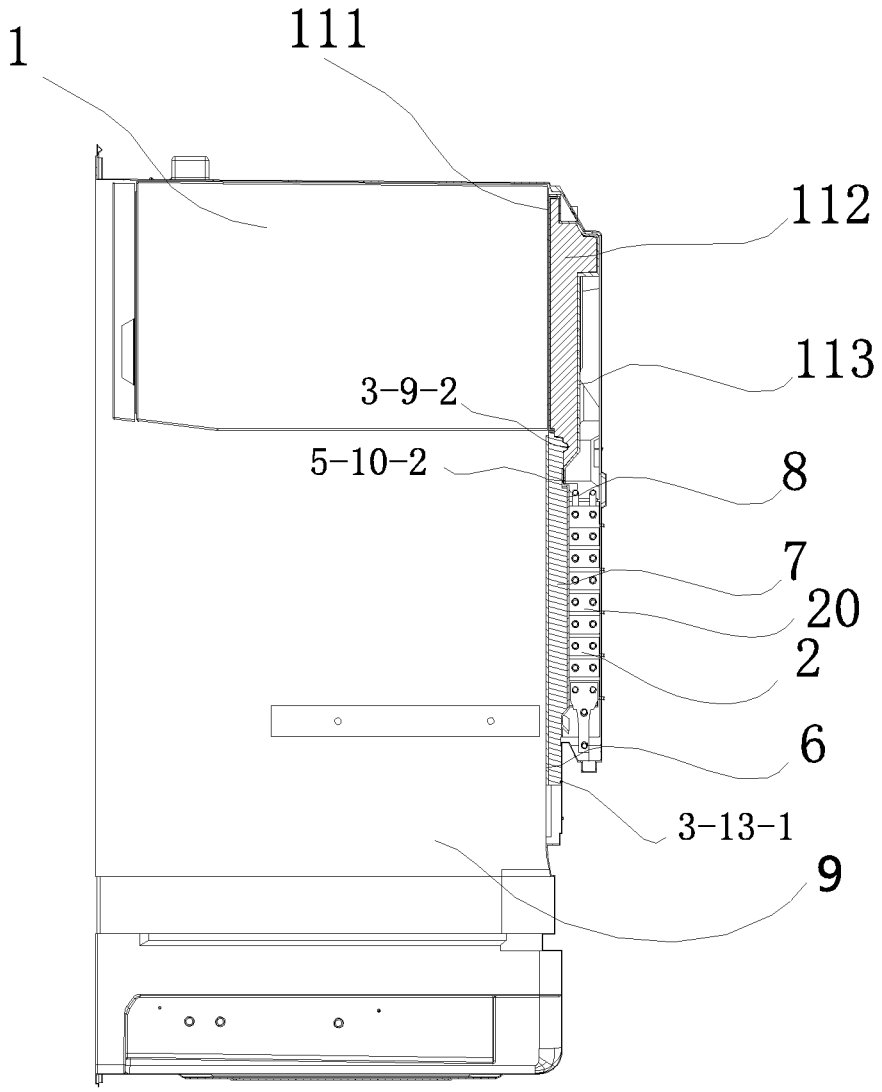
FIG. 5 is a schematic view showing the internal structure of the ice-making air supply duct of FIG. 1.

As shown in FIGS. 3 and 5, in this embodiment, the ice-making air supply duct 3 is constructed between the air duct rear cover plate 8 and the rear side wall of the refrigerating compartment liner 9, and the ice-making evaporator 2 is installed in the ice-making air supply duct 3. As can be seen, an air cavity 21 is formed between the air duct rear cover plate 8 and the rear side wall of the refrigerating compartment liner 9, and the ice-making air supply duct 3 is a part of the air cavity. By disposing the ice-making evaporator 2 in the ice-making air supply duct 3, it is possible to facilitate direct and rapid transport of the cold air inside the ice-making evaporator 2 into the ice maker 1 inside the ice-making chamber through the ice-making air supply duct 3, such that the water in the ice trays of the ice maker is rapidly converted into all-solid ice cubes, thereby greatly improving the ice-making efficiency.

As shown in FIG. 3, the refrigerator in accordance with the disclosure can further comprise a defrosting heating tube 10 disposed below the ice-making evaporator 2 and provided in inlet of the ice-making air supply duct 3 and outlet of the ice-making air return duct 5, and in upstream of the ice-making air supply duct than the ice-making evaporator 2. It should be noted that, during the defrosting operation, the heat of the defrosting heating tube 10 can be simultaneously transmitted to the ice-making air inlet duct 3 and the ice-making air return duct 5 for defrosting, thereby avoiding the case that the ice blockage of the ice-making air return duct 5 occurs.

In addition, since the ice-making air supply duct 3 and the ice-making air return duct 5 are arranged in parallel, the sealing fitting surfaces with the ice maker 1 are effectively reduced, so that the sealing structure is more simple and reliable.

As shown in FIGS. 1, 2, 3, 4, 5 and 7, in another embodiment of the present disclosure, the ice-making air supply duct 3 and the ice-making air return duct 5 are both located between the ice-making evaporator 2 and the ice maker 1.

The ice-making fan 4 is disposed between the ice-making air supply duct 3 and the ice-making air return duct 5 through the ice-making fan base 16. The arrangement of the ice-making fan base 16 can improve the fixing strength and the fixing stability of the ice-making fan 4, and prevent the ice-making fan 4 from falling.

An ice-making inner air duct 1*a* is constructed in the ice maker 1, and the ice-making air supply duct 3, the ice-making inner air duct 1*a* and the ice-making air return duct 5 are sequentially in communication with each other and form the refrigerating circulation loop. In this way, the cold air can be continuously transferred to the inside of the ice maker 1 to exchange heat with the air in the ice maker 1, so that the purpose of cooling the interior of the ice maker 1 is achieved, and the water in the ice trays of the ice maker 1 may be rapidly converted into all-solid ice cubes, thereby improving the ice-making efficiency.

As shown in FIG. 2, the refrigerator in accordance with the disclosure can further comprises a cover plate assembly 11 disposed on a rear side of the ice maker 1 and capable of sealing the inside of the ice maker 1, the cover plate assembly 11 includes an ice maker front cover plate 111, ice maker back cover foam 112, and an ice maker rear cover plate 113 disposed in order from front to rear. It should be noted that the ice maker front cover plate 111, the ice maker back cover foam 112, and the ice maker rear cover plate 113 can be fastened into a whole by screws, and then integrally mounted at the rear side of the ice maker 1, thereby realizing the sealing of the interior of the ice maker 1.

In one embodiment, the ice-making evaporator 2 is mounted on the outer side surface of the rear side wall of the refrigerating compartment liner 9. As can be seen, the ice-making evaporator 2 can be fixedly mounted on the outer side surface of the rear side wall of the refrigerating compartment liner 9 by a fastener such as a screw.

As shown in FIG. 2, in another embodiment, the refrigerator is further schematically shown to further include a refrigerating refrigeration system disposed in the refrigerating compartment, the refrigerating refrigeration system includes a refrigerating evaporator 12, a refrigerating air supply duct 13, a refrigerating fan 14, and a refrigerating air return duct 20, wherein the refrigerating air supply duct 13 is constructed between the air duct foam 7 and the air duct rear cover plate 8, the refrigerating fan 14 directs cold air into the refrigerating air supply duct 13. The refrigerating refrigeration system is configured to refrigerate in the refrigerating compartment so as to ensure that the temperature of the refrigerating compartment can be kept constant at all times, and the temperature in the refrigerating compartment can be 5 degrees above zero.

Thus it can be seen, the refrigerating refrigeration system for refrigerating in the refrigerating compartment according to the present disclosure and the ice-making refrigeration system for refrigerating in the ice maker 1 are independent of each other and two separate refrigeration systems that are not communicated. Therefore, in the process of making ice, the temperature in the refrigerating compartment is not affected at all, and the normal use of the refrigerating compartment can be ensured.

A refrigerating air return duct 20 is constructed between the air duct rear cover plate 8 and the rear side wall of the refrigerating compartment liner 9. That is, the refrigerating air return duct 20 is a part of the air cavity constituted by the rear side wall of the refrigerating compartment liner 9 and the air duct rear cover plate 8.

In one embodiment, the air duct front cover plate 6 and the air duct rear cover plate 8 are mounted on an outer side of the rear side wall of the refrigerating compartment liner 9 by screws. That is, the air duct front cover plate 6 and the air duct rear cover plate 8 are detachably connected and fastened to the outer side surface of the rear side wall of the refrigerating compartment liner 9 by screws or rivets.

Figure 4:
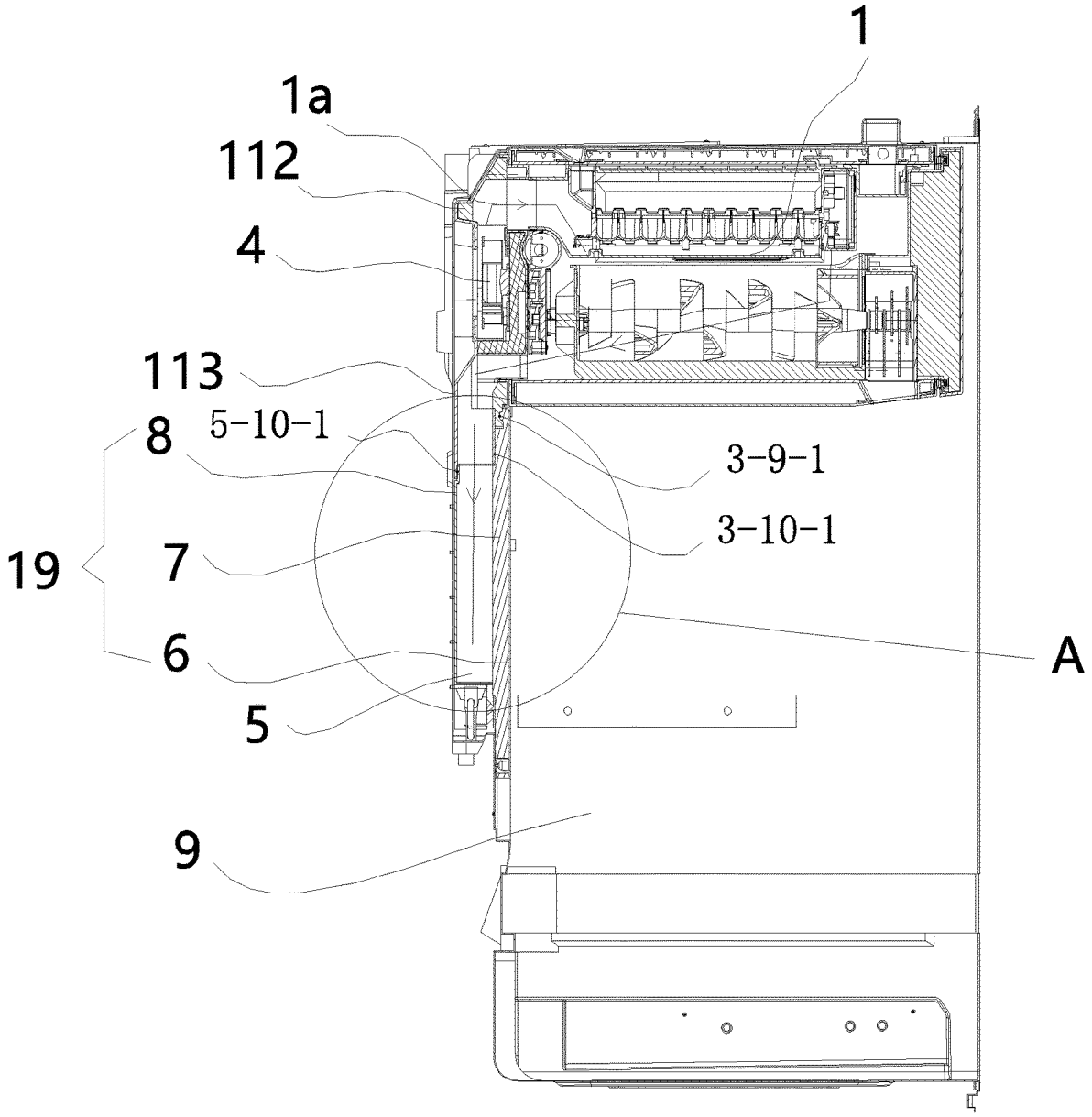
FIG. 4 is a schematic view showing the internal structure of the ice-making air return duct of FIG. 1.
Figure 6:
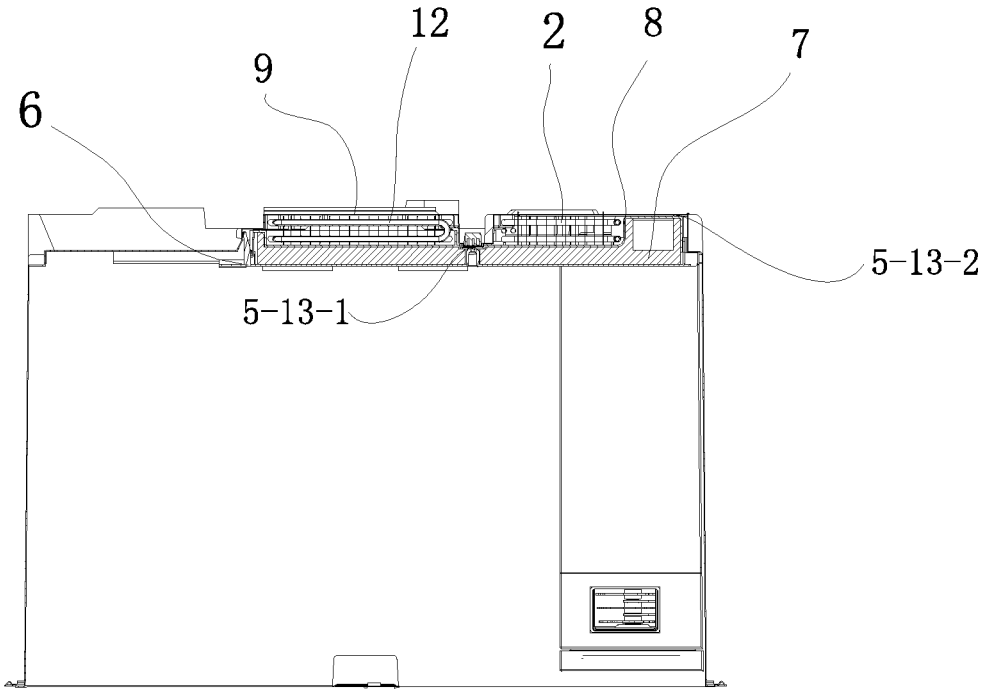
FIG. 6 is a schematic cross-sectional structural view corresponding to the ice-making evaporator and the refrigerating evaporator of FIG. 1.
Figure 7:
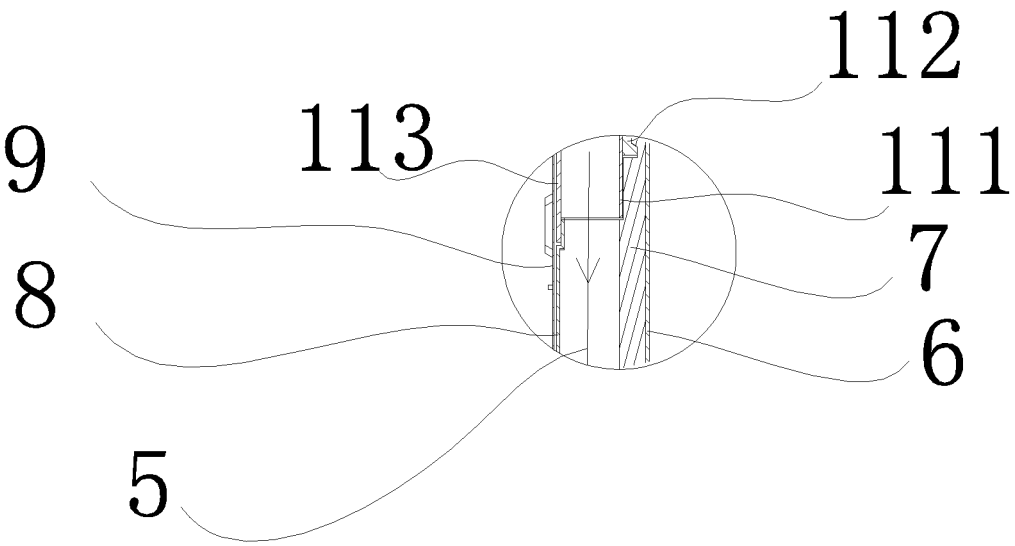
FIG. 7 is a partial enlarged view showing A of FIG. 4.

As shown in FIGS. 4, 5 and 6, in an embodiment of the present disclosure, in the ice-making air supply duct 3, the air duct foam 7 and the ice maker rear cover plate foam 112 are engaged and sealed in a concave-convex manner by a first fitting surface 3-9-2.

The air duct rear cover plate 8 and the ice maker rear cover plate 113 are lapped and sealed from front to rear by a second fitting surface 5-10-2.

The air duct foam 7 and the refrigerating compartment liner 9 are sealed at the lower part by a third fitting surface 3-13-1.

The air duct rear cover plate 8 and the refrigerating compartment liner 9 are fixedly sealed by a fourth fitting surface 5-13-1 through a screw at the left side.

In another embodiment, in the ice-making air return duct 5, the air duct foam 7 and the ice maker front cover plate foam 112 are engaged and sealed in a concave-convex manner by a fifth fitting surface 3-9-1.

The air duct foam 7 and the ice maker rear cover plate 113 are lapped and sealed by a sixth fitting surface 3-10-1.

The air duct rear cover plate 8 and the ice maker rear cover plate 113 are lapped and sealed from front to rear by a seventh fitting surface 5-10-1.

The air duct rear cover plate 8 and the refrigerating compartment liner 9 are sealed by an eighth fitting surface 5-13-2 through a sponge at the right side.

It should be noted that the formation of the fourth fitting surface 5-13-1 can effectively prevent the cold air in the ice-making refrigeration system from entering the refrigerating air supply duct 13 and resulting in frosting of the cold storage evaporator 12.

The formation of the eighth fitting surface 5-13-2 can prevent cold air from entering the refrigerating compartment, and further prevent the temperature in the refrigerating compartment from being too low to make the temperature of the refrigerating compartment cannot be maintained within an appropriate range, thereby affecting the normal operation of refrigerating compartment.

It should be noted that the above-mentioned first to eighth fitting surfaces 5-13-2 are formed in order to seal and prevent leakage of cold air, that is, prevent the cold air from exchanging and mixing between the refrigerating refrigeration system and the ice-making refrigeration system. At the same time, the case that the leakage of cold air to the outside of the refrigerator is prevented. In this way, the ice-making efficiency is greatly improved and the cooling efficiency in the refrigerating compartment of the refrigerator is effectively ensured.

In sum up, the cold air of the ice-making evaporator 2 is introduced to the inside of the ice maker 1 through the ice-making air supply duct 3 by the ice-making fan 4 and exchanges heat with the air in the ice maker 1 after being transferred into the ice maker 1, heat-exchanged cold air is introduced back to the inside of the ice-making evaporator 2 by the ice-making air return duct 5 and the heat exchange is repeated, and the above steps are executed cyclically.

The arrangement of the ice-making fan 4 can speed up the flow velocity of cold air as well as the refrigerating circulation, thereby improving the refrigerating efficiency.

In addition, since the space in the refrigerating compartment is much larger than the space of the ice-making chamber 2, it is convenient to install the ice-making evaporator 2 and increase the effective area of the ice-making evaporator 2, the heat load of the ice maker 1 and the area of the ice-making evaporator 2 are more rationally matched, the ice-making speed of the ice maker 1 is increased, the frost-reducing capacity of the ice-making evaporator 2 is improved, the heating defrosting frequency of the ice-making evaporator 2 is lowered, the energy consumption is reduced, and the surface quality of the ice cubes is improved.

In the present disclosure, since the ice maker 1 and an ice-making evaporator 2 are disposed in the refrigerating compartment of the refrigerator respectively, the cold air is introduced into the inside of the ice maker 1 in the ice-making chamber through a shorter ice-making air supply duct 3 by an ice-making fan 4 disposed at the back of the ice-making chamber for making ice, and thus the loss of cooling capacity is small and the ice-making efficiency is ensured.

In addition, since the ice-making air supply duct 3 and the ice-making air return duct 5 in the present disclosure are arranged in parallel in the refrigerating compartment, the ice-making air supply duct 3 and the ice-making air return duct 5 can be made thinner, and thus the occupied space inside the refrigerating compartment of the refrigerator can be decreased and the available volume of the refrigerator can be increased.

The embodiments above are only the preferred embodiments of the present disclosure, and are not intended to limit the disclosure. Any modifications, equivalent substitutions, improvements, etc., which are within the spirit and principles of the present disclosure, should be included in the protection scope of the present disclosure.

What is claimed is:

1. A refrigerator having an ice-making system, comprising:

a refrigerating compartment;

an ice-making chamber disposed inside the refrigerating compartment, wherein an ice maker is arranged inside the ice-making chamber, and an ice-making refrigeration system configured to refrigerate the ice-making chamber, wherein the ice-making refrigeration system includes:

an ice-making air supply duct provided inside the refrigerating compartment;

an ice-making evaporator provided in an upstream portion of the ice-making air supply duct, wherein the ice-making evaporator is disposed inside the refrigerating compartment and outside the ice-making chamber;

an ice-making fan provided in a downstream portion of the ice-making air supply duct, wherein the ice-making fan is provided in a back portion of the ice-making chamber and inside the refrigerating compartment; and an ice-making air return duct provided inside the refrigerating compartment, wherein the ice-making air supply duct and the ice-making air return duct are arranged outside of the ice-making chamber and positioned at a left side and a right side on the back of the refrigerator respectively, and the ice-making evaporator is air communicated with the ice maker through the ice-making air supply duct and the ice-making air return duct to form a refrigerating circulation loop;

wherein the refrigerator further comprising a refrigerating ice-making air duct disposed in the refrigerating compartment, the refrigerating ice-making air duct includes an air duct front cover plate, air duct foam, and an air duct rear cover plate disposed in order of front to rear, wherein, the ice-making air return duct is provided between the air duct foam and the air duct rear cover plate, and the air duct front cover plate is disposed on an outer surface of the rear wall of a refrigerating compartment liner;

wherein the refrigerator further comprising a cover plate assembly disposed on a rear side of the ice maker and configured to seal inside of the ice maker, wherein the cover plate assembly includes an ice maker front cover plate, ice maker back cover foam, and an ice maker rear cover plate disposed in order of front to rear; and the ice-making evaporator is mounted on an outer side of the rear side wall of the refrigerating compartment liner.

2. The refrigerator having an ice-making system of claim 1, wherein the ice-making air supply duct is provided between the air duct rear cover plate and a rear wall of the refrigerating compartment liner, and the ice-making evaporator is installed in the ice-making air supply duct.

3. The refrigerator having an ice-making system of claim 2, further comprising a defrosting heating tube provided near an inlet of the ice-making air supply duct and an outlet of the ice-making air return duct, and further upstream in the ice-making air supply duct than the ice-making evaporator.

4. The refrigerator having an ice-making system of claim 1, wherein the ice-making air supply duct and the ice-making air return duct are both located between the ice-making evaporator and the ice maker;

the ice-making fan is disposed between the ice-making air supply duct and the ice-making air return duct and provided on an ice-making fan base;

an ice-making inner air duct is provided in the ice maker, and the ice-making air supply duct, the ice-making inner air duct and the ice-making air return duct are sequentially connected to form the refrigerating circulation loop.

5. The refrigerator having an ice-making system of claim 1, further comprising a main refrigeration system disposed in the refrigerating compartment, wherein the main refrigeration system includes a refrigerating evaporator, a refrigerating air supply duct, a refrigerating fan, and a refrigerating air return duct, wherein the refrigerating air supply duct is provided between the air duct foam and the air duct rear cover plate, and the refrigerating fan directs cold air into the refrigerating air supply duct; and the refrigerating air return duct is provided between the air duct rear cover plate and the rear wall of the refrigerating compartment liner.

6. The refrigerator having an ice-making system of claim 1, wherein the air duct front cover plate and the air duct rear cover plate are mounted on an outer side of the rear wall of the refrigerating compartment liner.

7. The refrigerator having an ice-making system of claim 1, wherein in the ice-making air supply duct, the air duct foam and the ice maker rear cover plate foam are engaged and sealed in a concave-convex manner by a first fitting surface;

the air duct rear cover plate and the ice maker rear cover plate are lapped and sealed from front to rear by a second fitting surface;

the air duct foam and the refrigerating compartment liner are sealed by a third fitting surface; and the air duct rear cover plate and the refrigerating compartment liner are sealed by a fourth fitting surface.

8. The refrigerator having an ice-making system of claim 1, wherein in the ice-making air return duct, the air duct foam and the ice maker rear cover plate foam are engaged and sealed by a fifth fitting surface;

the air duct foam and the ice maker rear cover plate are lapped and sealed by a sixth fitting surface;

the air duct rear cover plate and the ice maker rear cover plate are lapped and sealed by a seventh fitting surface; and the air duct rear cover plate and the refrigerating compartment liner are sealed by a eighth fitting surface.

* * * * *